US007322818B2

(12) United States Patent
Stephens et al.

(10) Patent No.: US 7,322,818 B2
(45) Date of Patent: Jan. 29, 2008

(54) METHOD FOR ADJUSTING PRE-MIX BURNERS TO REDUCE $NO_X$ EMISSIONS

(75) Inventors: George Stephens, Humble, TX (US); David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 10/388,832

(22) Filed: Mar. 14, 2003

(65) Prior Publication Data

US 2003/0175646 A1 Sep. 18, 2003

Related U.S. Application Data

(60) Provisional application No. 60/365,236, filed on Mar. 16, 2002.

(51) Int. Cl.
*F23M 3/00* (2006.01)
*F23C 9/00* (2006.01)

(52) U.S. Cl. ..... 431/9; 431/5; 431/115; 126/91 A

(58) Field of Classification Search ..... 431/9, 431/5, 115, 215; 126/91 A
See application file for complete search history.

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |
| 2,983,312 | A | 5/1961 | Finley et al. |
| 3,880,570 | A | 4/1975 | Marshall |
| 4,004,875 | A | 1/1977 | Zink et al. |
| 4,089,629 | A | 5/1978 | Baumgartner et al. |
| 4,130,388 | A | 12/1978 | Flanagan |
| 4,230,445 | A | 10/1980 | Janssen |
| 4,257,763 | A | 3/1981 | Reed |
| 4,575,332 | A | 3/1986 | Oppenberg et al. |
| 4,629,413 | A | 12/1986 | Michelson et al. |
| 4,708,638 | A | 11/1987 | Brazier et al. |
| 4,739,713 | A | 4/1988 | Vier et al. |
| 4,748,919 | A | 6/1988 | Campobenedetto et al. |
| 4,815,966 | A | 3/1989 | Janssen |
| 4,828,483 | A | 5/1989 | Finke |

(Continued)

FOREIGN PATENT DOCUMENTS

| | | |
|---|---|---|
| CA | 1169753 | 6/1984 |

(Continued)

OTHER PUBLICATIONS

Chemical Engineering Progress, vol. 43, 1947, "The Design of Jet Pumps" by A. Edgar Kroll, pp. 21-24, vol. 1, No. 2.

(Continued)

*Primary Examiner*—Alfred Basichas

(57) ABSTRACT

A method for reducing $NO_x$ emissions from a furnace having multiple burners, each burner including at least one chamber for supplying a flow of combustion air and means to adjust the flow of air to the at least one chamber. The method includes the steps of measuring a parameter correlative of combustion air flow; adjusting the flow of combustion air to the at least one chamber so that the parameter is within a predetermined tolerance; and repeating the aforementioned steps for a plurality of burners.

10 Claims, 4 Drawing Sheets

U.S. PATENT DOCUMENTS

| | | | | |
|---|---|---|---|---|
| 4,963,089 | A | | 10/1990 | Spielman |
| 4,995,807 | A | | 2/1991 | Rampley et al. |
| 5,044,931 | A | | 9/1991 | Van Eerden et al. |
| 5,073,105 | A | | 12/1991 | Martin et al. |
| 5,092,761 | A | | 3/1992 | Dinicolantonio |
| 5,098,282 | A | | 3/1992 | Schwartz et al. |
| 5,135,387 | A | | 8/1992 | Martin et al. |
| 5,152,463 | A | | 10/1992 | Mao et al. |
| 5,154,596 | A | | 10/1992 | Schwartz et al. |
| 5,195,884 | A | | 3/1993 | Schwartz et al. |
| 5,201,650 | A | | 4/1993 | Johnson |
| 5,224,851 | A | | 7/1993 | Johnson |
| 5,238,395 | A | | 8/1993 | Schwartz et al. |
| 5,254,325 | A | * | 10/1993 | Yamasaki et al. ..... 423/450 |
| 5,263,849 | A | | 11/1993 | Irwin et al. |
| 5,269,679 | A | | 12/1993 | Syska et al. |
| 5,275,554 | A | | 1/1994 | Faulkner |
| 5,284,438 | A | | 2/1994 | McGill et al. |
| 5,299,930 | A | | 4/1994 | Weidman |
| 5,316,469 | A | | 5/1994 | Martin et al. |
| 5,326,254 | A | | 7/1994 | Munk |
| 5,344,307 | A | | 9/1994 | Schwartz et al. |
| 5,350,293 | A | | 9/1994 | Khinkis et al. |
| 5,370,526 | A | | 12/1994 | Buschulte et al. |
| 5,407,345 | A | | 4/1995 | Robertson et al. |
| 5,413,477 | A | | 5/1995 | Moreland |
| 5,470,224 | A | | 11/1995 | Bortz |
| 5,472,341 | A | | 12/1995 | Meeks |
| 5,542,839 | A | | 8/1996 | Kelly |
| 5,562,438 | A | | 10/1996 | Gordon et al. |
| 5,575,153 | A | * | 11/1996 | Ito et al. ..... 60/737 |
| 5,584,684 | A | | 12/1996 | Dobbeling et al. |
| 5,603,906 | A | | 2/1997 | Lang et al. |
| 5,611,682 | A | | 3/1997 | Slavejkov et al. |
| 5,624,253 | A | | 4/1997 | Sulzhik et al. |
| 5,685,707 | A | * | 11/1997 | Ramsdell et al. ..... 431/90 |
| 5,688,115 | A | * | 11/1997 | Johnson ..... 431/9 |
| 5,807,094 | A | | 9/1998 | Sarv |
| 5,813,846 | A | * | 9/1998 | Newby et al. ..... 431/9 |
| 5,980,243 | A | | 11/1999 | Surbey et al. |
| 5,984,665 | A | | 11/1999 | Loftus et al. |
| 5,987,875 | A | | 11/1999 | Hilburn et al. |
| 5,993,193 | A | | 11/1999 | Loftus et al. |
| 6,007,325 | A | | 12/1999 | Loftus et al. |
| 6,056,538 | A | | 5/2000 | Büchner et al. |
| 6,332,408 | B2 | * | 12/2001 | Howlett et al. ..... 110/189 |
| 6,347,935 | B1 | | 2/2002 | Schindler et al. |
| 6,383,462 | B1 | * | 5/2002 | Lang ..... 423/235 |
| 6,616,442 | B2 | | 9/2003 | Venizelos et al. |

FOREIGN PATENT DOCUMENTS

| | | |
|---|---|---|
| DE | 2944153 | 5/1981 |
| DE | 3232421 | 3/1984 |
| DE | 3818265 | 11/1989 |
| EP | 0099828 | 6/1988 |
| EP | 0 347 956 | 12/1989 |
| EP | 0 374 423 | 6/1990 |
| EP | 0 408 171 A1 | 1/1991 |
| EP | 0 507 233 | 10/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| FR | 2629900 | 10/1988 |
| SU | 374488 | 3/1973 |

OTHER PUBLICATIONS

Straitz III, John F., et al., "Combat NOx With Better Burner Design," *Chemical Engineering*, Nov. 1994, pp. EE-4-EE-8.

Vahdati, M. M., et al., "Design And Development of A Low NOx Coanda Ejector Burner," *Journal of the Institute of Energy*, Mar. 2000, vol. 73, pp. 12-17.

Bussman, Wes, et al., "Low NOx Burner Technology for Ethylene Cracking Furnaces," presented at the *2001 AIChE Spring National Meeting, 13th Annual Ethylene Producers Conference*, Houston, TX, Apr. 25, 2001, pp. 1-23.

Seebold, James G., "Reduce Heater NOx in the Burner," *Hydrocarbon Processing*, Nov. 1982, pp. 183-186.

"West Germany's Calorie Develops a Low-NOx Recycling Fuel Burner," *Chemical Engineering*, Oct. 4, 1982, p. 17.

* cited by examiner

METHOD FOR ADJUSTING PRE-MIX BURNERS TO REDUCE $NO_X$ EMISSIONS

RELATED APPLICATIONS

This patent application claims priority from Provisional Application Ser. No. 60/365,236, filed on Mar. 16, 2002, the contents of which are hereby incorporated by reference.

FIELD OF THE INVENTION

This invention relates to a method for adjusting burners of the type employed in high temperature furnaces. More particularly, it relates to a method of adjusting a plurality of pre-mix burners in a furnace to reduce $NO_x$ emissions.

BACKGROUND OF THE INVENTION

As a result of the interest in recent years to reduce the emission of pollutants from large industrial furnaces employing a plurality of burners significant improvements have been made in burner design. In the past, burner design improvements were aimed primarily at improving heat distribution. Increasingly stringent environmental regulations have shifted the focus of burner design to the minimization of regulated pollutants and to methods to reduce emissions from to the furnace itself.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations.

The rate at which $NO_x$ is formed is dependent upon the following variables: (1) flame temperature, (2) residence time of the combustion gases in the high temperature zone and (3) excess oxygen supply. The rate of formation of $NO_x$ increases as flame temperature increases. However, the reaction takes time and a mixture of nitrogen and oxygen at a given temperature for a very short time may produce less $NO_x$ than the same mixture at a lower temperature, over a longer period of time.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either pre-mix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763. In addition, many raw gas burners produce luminous flames.

Pre-mix burners mix the fuel with some or all of the combustion air prior to combustion. Since pre-mixing is accomplished by using the energy present in the fuel stream, airflow is largely proportional to fuel flow. As a result, therefore, less frequent adjustment is required. Pre-mixing the fuel and air also facilitates the achievement of the desired flame characteristics. Due to these properties, pre-mix burners are often compatible with various steam cracking furnace configurations.

Floor-fired pre-mix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a pre-mix burner is the burner of choice for such furnaces. Pre-mix burners can also be designed for special heat distribution profiles or flame shapes required in other types of furnaces.

One technique for reducing $NO_x$ that has become widely accepted in industry is known as combustion staging. With combustion staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Combustion staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

The majority of recent low $NO_x$ burners for gas-fired industrial furnaces is based on the use of multiple fuel jets in a single burner. Such burners may employ fuel staging, flue-gas recirculation, or a combination of both. U.S. Pat. Nos. 5,098,282 and 6,007,325 disclose burners using a combination of fuel-staging and flue-gas recirculation.

In the context of pre-mix burners, the term primary air refers to the air pre-mixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

U.S. Pat. No. 4,629,413 discloses a low $NO_x$ pre-mix burner and discusses the advantages of pre-mix burners and methods to reduce $NO_x$ emissions. The pre-mix burner of U.S. Pat. No. 4,629,413 lowers $NO_x$ emissions by delaying the mixing of secondary air with the flame and allowing some cooled flue gas to recirculate with the secondary air. The contents of U.S. Pat. No. 4,629,413 are incorporated by reference in their entirety.

U.S. Pat. No. 5,092,761 discloses a method and apparatus for reducing $NO_x$ emissions from pre-mix burners by recirculating flue gas. Flue gas is drawn from the furnace through a pipe or pipes by the aspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The flue gas recirculating system may be retrofitted into existing pre-mix burners or may be incorporated in new low $NO_x$ burners. The contents of U.S. Pat. No. 5,092,761 are incorporated by reference in their entirety.

Typical industrial furnaces for steam cracking or reforming employ multiple burners of the types described above. The burners described above typically are sized to fire from 0.3 to 2.5 MW (1-8 M Btu/hr). In contrast, even moderately sized industrial furnaces for reforming or steam cracking furnaces have a total fuel firing of from 30 to 150 MW. Accordingly such furnaces may have anywhere from 20 to over 100 burners.

Imbalance problems with flue gas recirculation and primary air exists when multiple burners are operated in a furnace. Due to the normal variations or tolerance in construction, leakage of air, partial fouling or plugging of components during operation or poor consistency in adjusting the burners there is considerable variability in FGR and primary air rates between individual burners in a furnace. In order to obtain the lowest $NO_x$ production in a furnace having multiple burners it is necessary to operate all the burners in the furnace at substantially similar FGR and primary air rates. This is particularly the case as more and more stringent requirements are adopted for $NO_x$ with respect to environmental considerations.

Furnaces of varied burner designs are used to reduce $NO_x$ emissions, and can benefit from the invention. Included are furnaces utilizing pre-mix burners with staged air to reduce $NO_x$, furnaces with pre-mix burners and staged air and flue gas recirculation (FGR). Also included are furnaces utilizing pre-mix burners with staged fuel.

Despite these advances in the art, a need exists for an effective method for controlling the multiple burners used in an industrial furnace to meet the increasingly stringent $NO_x$ emission regulations, which minimizes localized sources of high $NO_x$ production.

Therefore, what is needed is a method to easily provide a means to adjust multiple burners in a furnace to minimize $NO_x$ production.

SUMMARY OF THE INVENTION

The present invention is directed to a method for reducing $NO_x$ emissions from a furnace having multiple burners, each burner including at least one chamber for supplying a flow of combustion air and means to adjust the flow of air to the at least one chamber. The method includes the steps of measuring a parameter correlative of combustion air flow; adjusting the flow of combustion air to the at least one chamber so that the parameter is within a predetermined tolerance; and repeating the aforementioned steps for a plurality of burners.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, the various burners that can utilize the invention.

DETAILED DESCRIPTION

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Reference is now made to a non-limiting selection of burners which can utilize the invention illustrated in FIGS. 1 through 4 wherein like numerals are used to designate like parts throughout.

Figure 1:
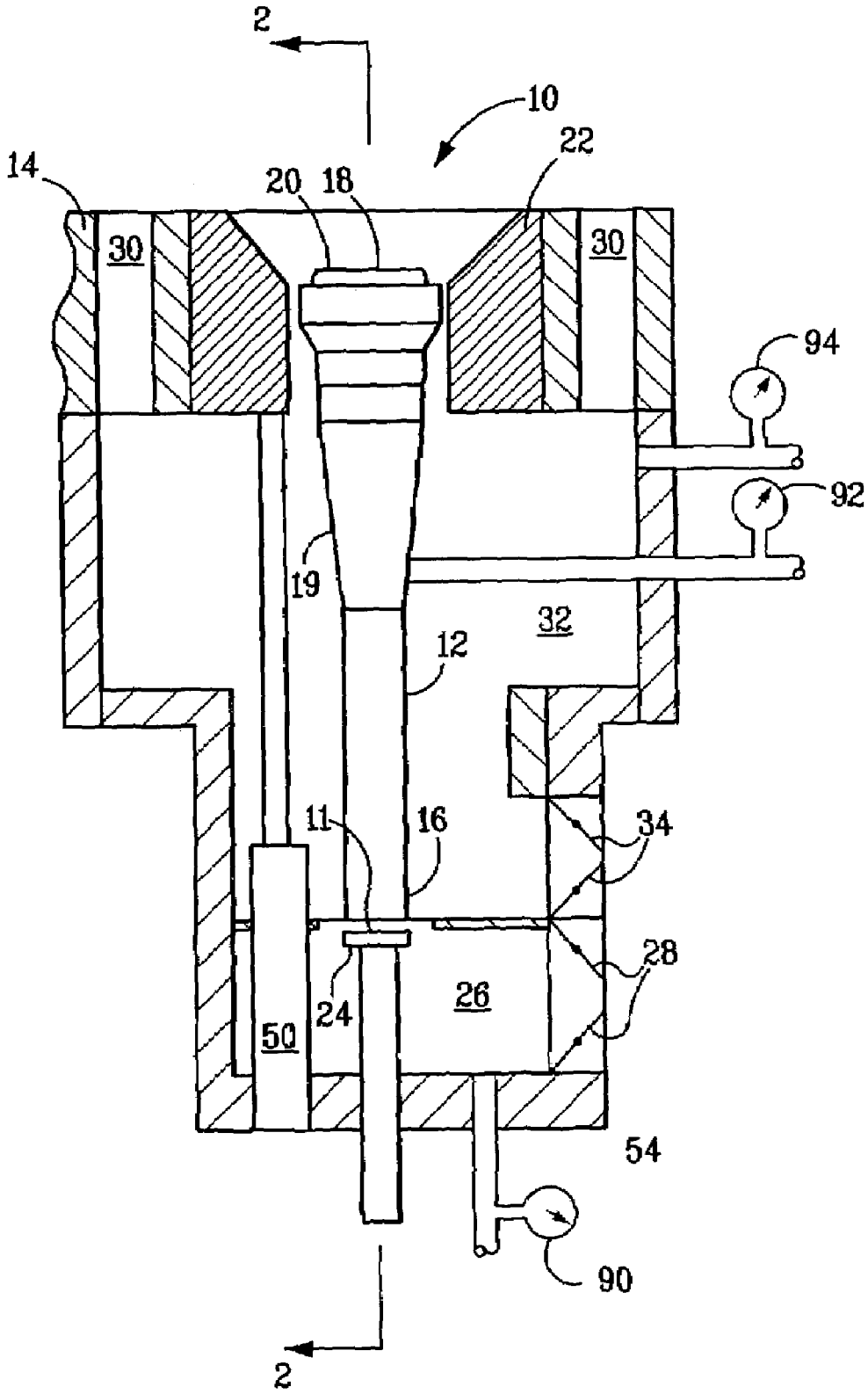
FIG. 1 illustrates an elevation partly in section of an embodiment of the burner of the present invention.
Figure 2:
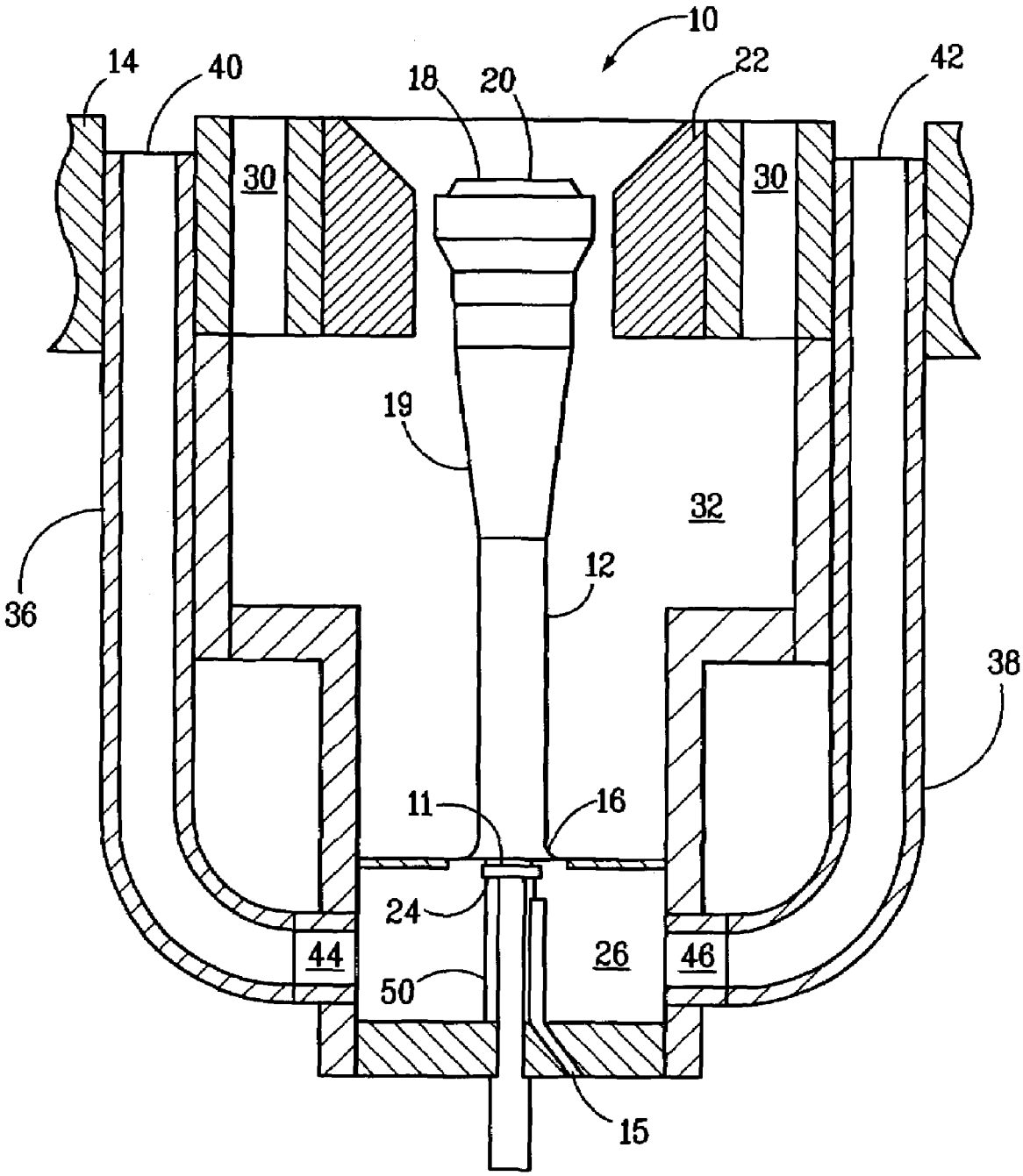
FIG. 2 is an elevation partly in section taken along line 2-2 of FIG. 1.

Referring now to FIG. 1 and FIG. 2, a pre-mix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. A fuel orifice 11, which may be located within gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of burner tip 20.

A plurality of air ports 30 originate in secondary air chamber 32 and passes through furnace floor 14 into the furnace. Fresh air enters secondary air chamber 32 through adjustable dampers 34 and passes through staged air ports 30 into the furnace to provide secondary or staged combustion, as described in U.S. Pat. No. 4,629,413.

In order to recirculate flue gas from the furnace to the primary air chamber, ducts, or pipes 36, 38 extend from openings 40, 42, respectively, in the floor of the furnace to openings 44, 46, respectively, in burner 10. Flue gas containing, for example, about 0 to about 15% $O_2$ is drawn through pipes 36, 38, with about 5 to about 15% $O_2$ preferred, about 2 to about 10% $O_2$ more preferred, and about 2 to about 5% $O_2$ particularly preferred, by the inspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. Closing or partially closing damper 28 restricts the amount of fresh air that can be drawn into the primary air chamber 26 and thereby provides the vacuum necessary to draw flue gas from the furnace floor.

Unmixed low temperature ambient air, having entered secondary air chamber 32 through dampers 34 and having passed through air ports 30 into the furnace, is also drawn through pipes 36, 38 into the primary air chamber by the aspirating effect of the fuel gas passing through venturi portion 19. The mixing of the ambient air with the flue gas lowers the temperature of the hot flue gas flowing through pipes 36, 38 and thereby substantially increases the life of the pipes and permits use of this type of burner to reduce $NO_x$ emission in high temperature cracking furnaces having flue gas temperature above 1900° F. in the radiant section of the furnace.

It has been observed that where increasingly stringent limitations on $NO_x$ are concerned with regard to large industrial furnaces with multiple burners that if only a few burners are performing poorly the total $NO_x$ emissions can increase dramatically. This can be illustrated by the following prophetic example which relates to a steam cracking furnace utilizing low $NO_x$ pre-mix burners employing staged air and flue gas recirculation.

In such a furnace, each burner typically is capable of achieving a $NO_x$ level of 0.05 lb. $NO_x$/MMBtu. Such a furnace may have a total of 20 or more such burners. It is observed that an individual burner which is performing poorly due to different tolerances or other factors may be producing 0.2 lb.$NO_x$MMBtu. Therefore if only 3 burners are poorly performing in this way the total $NO_x$ for the entire furnace would be at 0.07 versus the expected design value of 0.05 lb./MMBtu, a 40% increase in $NO_x$ emissions.

The normal construction tolerances on burner components result in different performance the multiple burners installed in a furnace with the same nominal dimensions. In particular, variations in the air dampers 28 and the linkages and mechanisms result in different burners achieving different primary air inspiration rates and therefore different $O_2$ concentrations in the venturi. This will happen even if the primary air dampers are opened approximately equally as judged by a visual observation. By following the method of this invention it is possible to reduce the total $NO_x$ emissions of the furnace in this situation.

According to the teachings of the present invention, modifications to the burners are made by providing for the addition of a means to measure a parameter which correlates with the air flow to the primary air chamber 26.

In one embodiment of the present invention, the vacuum or draft in the primary air chamber 26 is measured with a conventional manometer (not shown). Another preferred embodiment calls for measuring the vacuum or draft in the primary air chamber 26 with a draft gauge 90. In either case, the primary air damper 28 is then adjusted to give the same vacuum or draft in the primary air chamber 26 for each burner 10. This will provide the same primary air flow rate and essentially the same FGR rate, and therefore the same oxygen concentration in the venturi 12 of each burner 10.

The chamber pressure of primary air chamber 26 varies with the actual open area of the primary air door. Adjusting each damper 28 to achieve substantially the same primary air chamber pressure in each burner 10 in the furnace will make the performance of each burner 10 more consistent, and thereby avoid the imbalance defined above and thereby reduce the total $NO_x$ level of the furnace.

According to another embodiment of the present invention a velocity probe is used to measure the velocity of the air entering the primary air chamber 26. The velocity probe can be a vane anemometer or a pitot tube or a similar device known in the art. The velocity probe is used with a fitting having a known flow area such as a rectangular area. Given the velocity and flow area, a very accurate air mass flow rate can be calculated. Optionally, accuracy can be raised by measuring air temperature for temperature compensation purposes and used to make corresponding adjustments to further equalize the operation of the plurality of burners.

In yet another embodiment of the present invention, the oxygen content is measured by an $O_2$ analyzer which draws a sample from the venturi 19 in each burner 10. A sample port 92 may be provided in each venturi 19 for this purpose. Alternatively, a sample probe (not shown) may be inserted into the venturi 19.

Based upon readings taken by the selected device(s) mentioned above, the primary area chamber damper 28 for each burner 10 may then adjusted in order to achieve a consistent $O_2$ concentration for each burner 10.

Although the burner adjustment techniques described with relation to the burners of FIGS. 1 and 2 have been described in detail for adjustments made to the primary air chamber 26, it will be appreciated by those of skill in the art that the adjustment techniques can be advantageously applied to the secondary air chamber 32, as well. This is particularly important for the case where the primary air chamber damper 28 is set to the closed condition and flue gas, air or mixtures thereof are drawn into the primary chamber through pipes 36 and 38.

When the present invention is employed for secondary air chamber adjustment, the vacuum or draft in the secondary air chamber 32 may be measured with a conventional manometer (not shown) or with a draft gauge 94. In either case, the secondary air damper 34 is adjusted to give the same vacuum or draft in the secondary air chamber 32 for each burner 10.

Likewise, a velocity probe (not shown) may be used to measure the velocity of the air entering the secondary air chamber 32 and/or the oxygen content is measured by an $O_2$ analyzer, which draws a sample from the venturi 19 in each burner 10, through sample port 92.

Once again, based upon readings taken by the selected device(s), the secondary air chamber damper 34 is adjusted for each burner 10 to achieve a consistent $O_2$ concentration.

The burner adjustment teachings disclosed herein can alternatively be applied in flat-flame burners, as will now be described by reference to FIGS. 3 and 4.

A burner 410 includes a freestanding burner tube 412 located in a well in a furnace floor 414. Burner tube 412 includes an upstream end 416, a downstream end 418 and a venturi portion 419. Burner tip 420 is located at downstream end 418 and is surrounded by a peripheral tile 422. A fuel orifice 411, which may be located within gas spud 424 is located at upstream end 416 and introduces fuel gas into burner tube 412. Fresh or ambient air may be introduced into primary air chamber 426 to mix with the fuel gas at upstream end 416 of burner tube 412. Combustion of the fuel gas and fresh air occurs downstream of burner tip 420. Fresh secondary air enters secondary chamber 432 through dampers 434.

In order to recirculate flue gas from the furnace to the primary air chamber, a flue gas recirculation passageway 476 is formed in furnace floor 414 and extends to primary air chamber 426, so that flue gas is mixed with fresh air drawn into the primary air chamber from opening 480 through dampers 428. Flue gas containing, for example, 0 to about 15% $O_2$ is drawn through passageway 476 by the inspirating effect of fuel gas passing through venturi portion 419 of burner tube 412. Primary air and flue gas are mixed in primary air chamber 426, which is prior to the zone of combustion.

In operation, fuel orifice 411, which may be located within gas spud 424, discharges fuel into burner tube 412, where it mixes with primary air, recirculated flue-gas or mixtures thereof. The mixture of fuel gas, recirculated flue-gas, and primary air then discharges from burner tip 420.

As with the previous embodiments, the vacuum or draft in the primary air chamber 426 may be measured with a conventional manometer (not shown) or with a draft gauge 490. In either case, the primary air damper 428 is then adjusted to give the same vacuum or draft in the primary air chamber 426 for each burner 410.

Another embodiment of the present invention calls for attaching a velocity probe (not shown) to measure the velocity of the air entering the primary air chamber 426. In yet another embodiment associated with a flat-flame burner configuration, the oxygen content is measured by an $O_2$ analyzer which draws a sample from the venturi 419 in each burner 410. A sample port 494 may be provided in each venturi 419 for this purpose. Alternatively, a sample probe (not shown) may be inserted into the venturi 419.

Based upon readings taken by the selected device(s) mentioned above, the primary air chamber damper 428 is then adjusted on each burner 410 to achieve a consistent 02 concentration for each burner 410.

Figure 3:
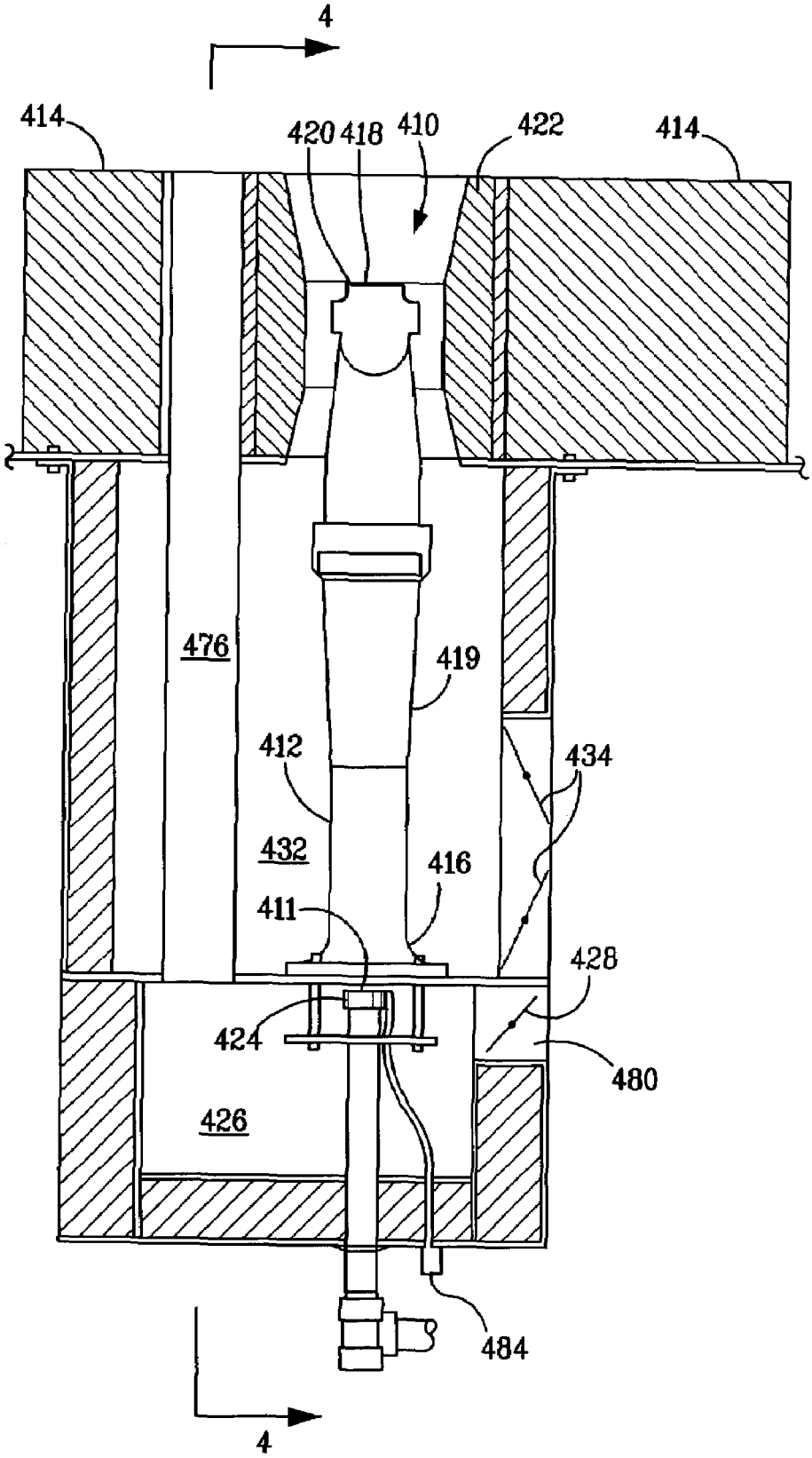
FIG. 3 illustrates an elevation partly in section of an embodiment of a flat-flame burner of the present invention.
Figure 4:
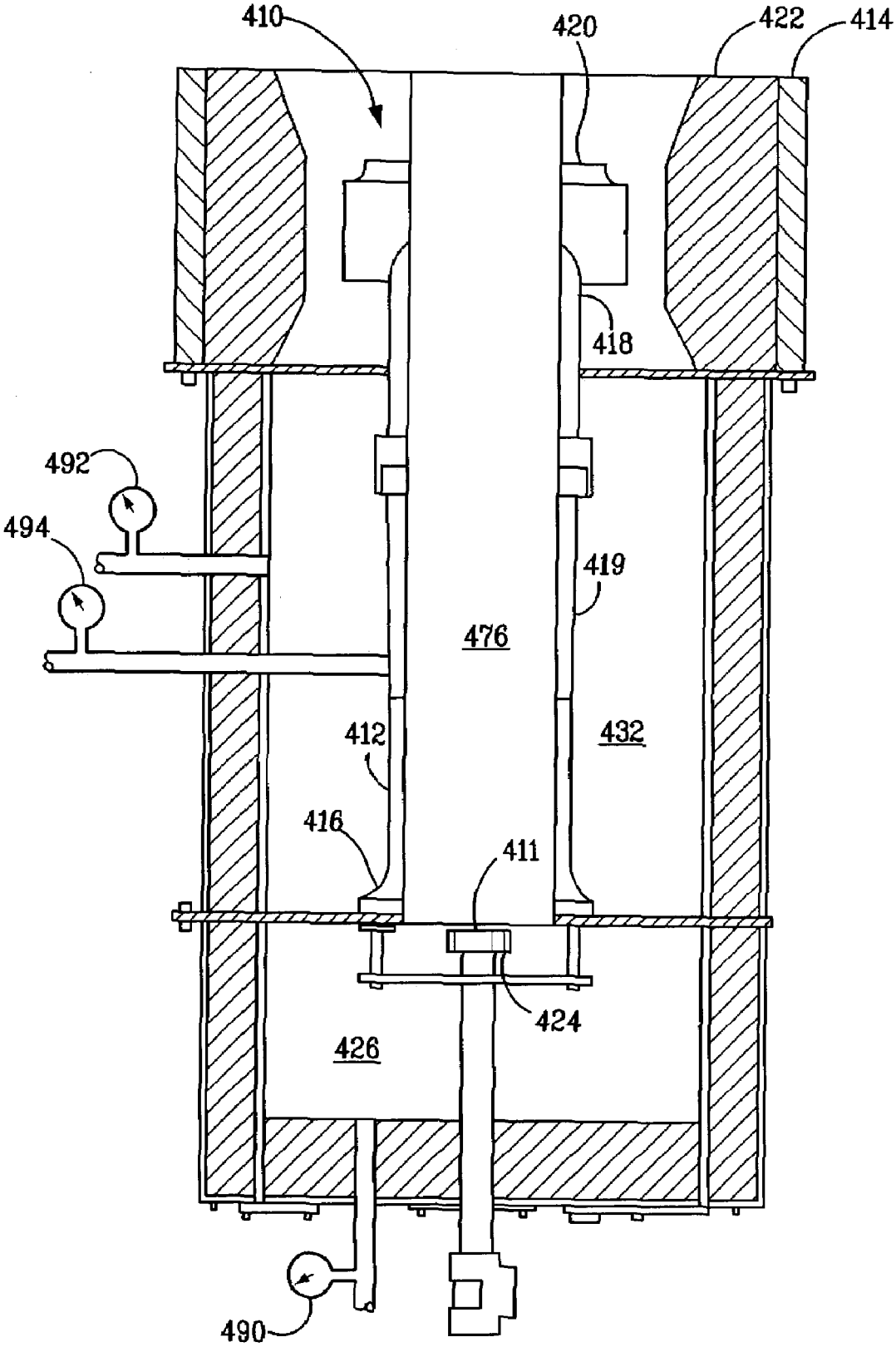
FIG. 4 is an elevation partly in section of the embodiment of a flat-flame burner of FIG. 3 taken along line 4-4 of FIG. 3.

Although the burner adjustment techniques described with relation to the flat-flame burners depicted in FIGS. 3 and 4 have been described in detail for adjustments made to the primary air chamber 426, it will be appreciated by those of skill in the art that the adjustment techniques can be advantageously applied to the secondary air chamber 432, as well. This is particularly important for the case where the primary air chamber damper 428 is set to the closed condition and flue gas, air or mixtures thereof drawn into the primary chamber through passageway 476.

When the present invention is employed for secondary air chamber adjustment, the vacuum or draft in the secondary air chamber 432 may be measured with a conventional manometer (not shown) or with a draft gauge 492. In either case, the secondary air damper 434 is adjusted to give the same vacuum or draft in the secondary air chamber 432 for each burner 410.

Likewise, a velocity probe (not shown) may be used to measure the velocity of the air entering the secondary air chamber 432 and/or the oxygen content is measured by an $O_2$ analyzer which draws a sample from the venturi 419 in each burner 410, through sample port 494.

Based upon readings taken by the selected device(s), the secondary air chamber damper 434 is adjusted for each burner 410 to achieve a consistent $O_2$ concentration.

In addition to the use of flue gas as a diluent, another technique to achieve lower flame temperature through dilution is through the use of steam injection. Steam can be injected in the primary air or the secondary air chamber. Steam injection may occur through, for example, steam injection tube 15, as shown in FIG. 2 or steam injection tube 484, as shown in FIG. 3. Preferably, steam may be injected upstream of the venturi.

Although illustrative embodiments have been shown and described, a wide range of modification change and substitution is contemplated in the foregoing disclosure and in some instances. Accordingly, it is appropriate that the appended claims be construed broadly and in a manner consistent with the scope of the embodiments disclosed herein.

What is claimed is:

1. A method for reducing $NO_x$ emissions from an industrial furnace having multiple pre-mix staged-air burners, each pre-mix staged-air burner including at least a primary air chamber and a secondary air chamber for supplying a flow of combustion air, at least one flue gas recirculation duct having a first end for receiving flue gas and a second end opening into the primary air chamber, a venturi to combine the fuel gas, flue gas and air, and means to adjust the flow of air to the primary air chamber and the secondary air chamber, the method comprising the steps of:

(a) measuring a parameter correlative of combustion air flow for each of the multiple pre-mix staged-air burners;

(b) adjusting the flow of combustion air by damping the primary air chamber and the secondary air chamber for each of the multiple pre-mix staged-air burners so that the parameter is within a predetermined tolerance; and (c) repeating steps (a) and (b) for each of the multiple pre-mix staged-air burners so as to reduce the furnace's total $NO_x$ level.

2. The method of claim 1, wherein the burner is a flat-flame burner.

3. The method of claim 1, wherein the parameter is oxygen concentration in the venturi.

4. The method of claim 1, wherein the parameter is vacuum.

5. The method of claim 4, wherein the parameter is measured by a manometer.

6. The method of claim 4, wherein the parameter is measured by a vacuum gauge.

7. The method of claim 1, wherein the parameter is air flow rate.

8. The method of claim 7, wherein the air flow rate is measured by a pitot tube placed in a duct.

9. The method of claim 8, wherein the duct is attached to the burner in front of a damper.

10. The method of claim 1, wherein the furnace is a steam-cracking furnace.

* * * * *